US006947697B2

(12) United States Patent
Fujimoto et al.

(10) Patent No.: US 6,947,697 B2
(45) Date of Patent: Sep. 20, 2005

(54) ULTRASONIC VIBRATION TOOL, FIXING DEVICE, AND HEATING DEVICE

(75) Inventors: Keisuke Fujimoto, Hirakata (JP); Masahiko Hashimoto, Kadoma (JP); Masaichiro Tatekawa, Minoo (JP)

(73) Assignee: Matsushita Electric Industrial Co., Ltd, Osaka (JP)

( * ) Notice: Subject to any disclaimer, the term of this patent is extended or adjusted under 35 U.S.C. 154(b) by 634 days.

(21) Appl. No.: 10/054,199

(22) Filed: Jan. 22, 2002

(65) Prior Publication Data

US 2004/0013449 A1 Jan. 22, 2004

(30) Foreign Application Priority Data

Jan. 22, 2001 (JP) ..... 2001-012675

(51) Int. Cl.[7] ..... G03G 15/20

(52) U.S. Cl. ..... 399/320; 219/216; 310/312; 310/323.19

(58) Field of Search ..... 399/319, 320, 399/329, 330; 219/216; 310/312, 322, 323.18, 323.19

(56) References Cited

U.S. PATENT DOCUMENTS

| | | | | |
|---|---|---|---|---|
| 4,363,992 A | * | 12/1982 | Holze, Jr. | 310/323.19 |
| 4,651,043 A | * | 3/1987 | Harris et al. | 310/323.19 |
| 4,749,437 A | * | 6/1988 | Welter | 156/580.1 |
| 5,339,147 A | * | 8/1994 | Snelling et al. | 399/333 |
| 5,390,013 A | * | 2/1995 | Snelling | 399/328 |
| 5,414,497 A | * | 5/1995 | Tsuchiya et al. | 399/272 |
| 5,850,117 A | * | 12/1998 | Tobe et al. | 310/312 |
| 6,205,315 B1 | * | 3/2001 | Montfort et al. | 399/319 |
| 6,496,680 B2 | * | 12/2002 | Fujimoto et al. | 399/329 |

FOREIGN PATENT DOCUMENTS

| | | | | |
|---|---|---|---|---|
| JP | 10323620 A | * | 12/1998 | B06B/1/02 |
| JP | 2002210412 A | * | 7/2002 | B06B/1/06 |

OTHER PUBLICATIONS

Collected Papers presented at the lecture meeting of the Acoustical Society of Japan (Oct., 1987); 1–2–12 Modal Vibration Control of Ultrasosnic Tools with the Use of Wave–trapped Horns by Kazunari Adachi and Sadayuki Ueha (Tokyo Institute of Technology) with partial English translation.

Collected Papers presented at the lecture meeting of the Acoustical Society of Japan (Mar., 1988); 1–6–10 Modal Vibration Control of Ultrasonic Tools with the Use of Wave–trapped Horns II by Kazunari Adachi and Sadayuki Ueha(Tokyo Institute of Technology) with partial English Translation.

* cited by examiner

*Primary Examiner*—Robert Beatty
(74) *Attorney, Agent, or Firm*—Jordan and Hamburg LLP

(57) ABSTRACT

An ultrasonic vibration tool is made of a block of substantially rectangular parallelepiped form, and has its one end face formed as an output end face, and has its other end face opposite the output end face formed as an input end face. An ultrasonic oscillator is connected to the input end face for transmitting a longitudinal standing wave to the output end face. Peripheries of the input and output end faces of the block constitute mass portions. Between the mass portions are formed slits at a pitch less than a half of an oscillation wavelength, whereby a plurality of elastic portions are obtained. The mass portion on the input end face side has a protrusion having a height equal to or less than a quarter of the oscillation wavelength, thereby obtaining a mass distribution. Hence, a uniform amplitude distribution is achieved in the output end face.

20 Claims, 9 Drawing Sheets

ULTRASONIC VIBRATION TOOL, FIXING DEVICE, AND HEATING DEVICE

The present disclosure relates to subject matter contained in priority Japanese Patent Application No. 2001-12675, filed on Jan. 22, 2001, the contents of which is herein expressly incorporated by reference in its entirety.

BACKGROUND OF THE INVENTION

1. Field of the Invention

The present invention relates to an ultrasonic vibration tool for applying ultrasonic vibration originating from an ultrasonic vibration source evenly across the width of the output end face thereof, and to a fixing device and a heating device employing the same.

2. Description of Related Art

As one of conventional ultrasonic vibration tools capable of applying ultrasonic vibration over a wide width range at one time, there is known an ultrasonic vibration tool 31 as shown in FIG. 9A that is made of a block 32 of substantially rectangular parallelepiped form. The block 32 has its one end face formed as an output end face 33, and has its other end face opposite the output end face 33 formed as an input end face 34, to the substantially central portion of which an ultrasonic vibration source 35 is connected. In this ultrasonic vibration tool 31, a longitudinal standing wave excited by the ultrasonic vibration source 35 is transmitted to the entire width of the output end face 33. The output and input end faces 33 and 34 of the block 32 each have an integral continuous portion serving as a mass portion 36. Between these mass portions 36 are formed slits 37 with a uniform pitch between one another, whereby a plurality of elastic portions 38 are formed.

However, the above stated ultrasonic vibration tool has the following disadvantage. As shown in FIG. 9B, in the ultrasonic vibration tool 31 whose configuration is represented by a dash-and-dot line, the vibrational mode observed when vibration is excited in the central portion of the input end face 34 is represented by a dash-dot-dot line. That is, in the output end face 33, the amplitude of vibration is large in the central portion thereof, but is small in the edge portions thereof. This makes it difficult to obtain a uniform amplitude with high accuracy across the entire width.

To overcome such a problem, for example, an ultrasonic vibration tool as shown in FIG. 10 has been proposed. In this construction, at each edge portion of the input end face is fitted an additional oscillator 39 having a length which is approximately equal to a half of a wavelength, which is called a wave-trapped horn. By exciting the additional oscillator 39 into resonance, the force to excite longitudinal vibration at the edges of the input end face 34 is increased, thereby achieving a uniform amplitude in the output end face 33 (refer to the collected papers presented at the lecture meeting of the Acoustical Society of Japan, pages 737–738, October, 1987, and pages 655–656, March, 1988). However, the additional oscillator 39 tends to cause parasitic oscillation of bending mode and thus fails to achieve a sufficiently uniform amplitude in the output end face.

Such a problem has a significant adverse effect particularly on a fixing device for use in an image forming apparatus which is required to ensure a uniform amplitude distribution with high accuracy.

SUMMARY OF THE INVENTION

The present invention has been made in light of the above stated problems with the conventional art, and accordingly an object of the present invention is to provide an ultrasonic vibration tool capable of achieving a uniform amplitude distribution in an output end face, and fixing and heating devices employing the same.

To achieve the above object, according to one aspect of the present invention, an ultrasonic vibration tool is made of a block of substantially rectangular parallelepiped form, and has its one end face formed as an output end face, and has its other end face opposite the output end face formed as an input end face. An ultrasonic vibration source is connected to the input end face, so that a longitudinal standing wave is transmitted to the output end face. A mass distribution is provided in the vicinity of the input end face so as to obtain a uniform amplitude distribution in the output end face. In this construction, a uniform amplitude distribution is achieved by the mass distribution provided near the input end face. Accordingly, the ultrasonic vibration tool is free from adverse effects such as parasitic oscillation of bending mode, and, despite having a simple structure, achieves a uniform amplitude distribution.

According to another aspect of the present invention, an ultrasonic vibration tool is made of a block of substantially rectangular parallelepiped form, and has its one end face formed as an output end face, and has its other end face opposite the output end face formed as an input end face. An ultrasonic vibration source is connected to the input end face, so that a longitudinal standing wave is transmitted to the output end face. In this construction, peripheries of the output and input end faces of the block each constitute a mass portion, and, between the mass portions are formed slits at a pitch which is less than a half, more preferably, equal to or less than a quarter, of an oscillation wavelength, whereby a plurality of elastic portions are formed. The elastic portions have mutually different elastic coefficients so as to achieve a uniform amplitude distribution in the output end face.

According to still another aspect of the present invention, a fixing device is provided with: the ultrasonic vibration tool; an ultrasonic vibration source; and a supporting member disposed opposite the output end face of the ultrasonic vibration tool. A fixation sheet is supplied between the output end face of the ultrasonic vibration tool and the supporting member. In this construction, since the amplitude distribution of the ultrasonic vibration tool is made uniform with high accuracy, vibrational energy is applied evenly across the entire width of the sheet while a developer is fixed, whereby high-quality images are realized with stability.

According to yet another aspect of the present invention, a fixing device is provided with: the ultrasonic vibration tool; an ultrasonic vibration source; a heat-transfer rotary body which is disposed opposite the output end face of the ultrasonic vibration tool, and has in its outer peripheral portion a heat generating and transferring layer; and a supporting member disposed opposite the heat-transfer rotary body. In this construction, a fixation sheet is supplied between the heat-transfer rotary body and the supporting member.

According to a further aspect of the present invention, a heating device is provided with: the ultrasonic vibration tool; an ultrasonic vibration source; and a supporting member disposed opposite the output end face of the ultrasonic vibration tool. A sheet being heated is supplied and discharged between the output end face of the ultrasonic vibration tool and the supporting member. In this construction, since the amplitude distribution of the ultrasonic vibration tool is made uniform with high accuracy, vibrational energy is applied evenly across the entire width of the sheet being heated, whereby the sheet is heated uniformly.

While novel features of the invention are set forth in the preceding, the invention, both as to organization and content, can be further understood and appreciated, along with other objects and features thereof, from the following detailed description and examples when taken in conjunction with the attached drawings.

BRIEF DESCRIPTION OF THE DRAWINGS

FIG. 1A shows a perspective view, and FIG. 1B shows a view for explaining a simulated vibrational mode;

FIG. 2A shows a perspective view, and FIG. 2B shows a sectional view taken along line IIB—IIB of FIG. 2A;

FIG. 3A shows a perspective view, and FIG. 3B shows a sectional view taken along line IIIB—IIIB of FIG. 3A;

FIG. 9A shows a perspective view, and FIG. 9B shows a view for explaining a simulated vibrational mode.

DETAILED DESCRIPTION OF THE PREFERRED EMBODIMENTS (First Embodiment)

First, with reference to FIGS. 1A to 2B, a first embodiment of the ultrasonic vibration tool according to the present invention will be described.

Figure 1A:
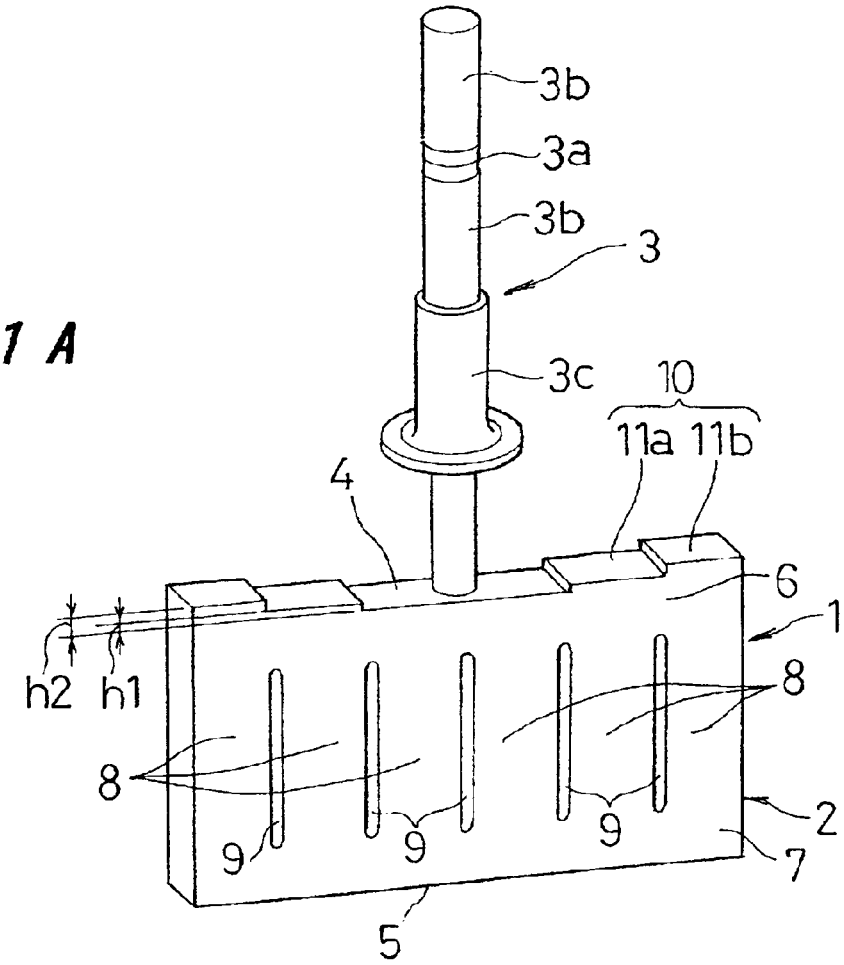
FIGS. 1A and 1B are diagrams of a ultrasonic vibration tool according to a first embodiment of the present invention, where

In FIG. 1A, numeral 1 represents an ultrasonic vibration tool made of a flat block 2 of rectangular parallelepiped form. In the ultrasonic vibration tool 1, connected to a central portion of an input end face 4 is an ultrasonic oscillator 3, acting as an ultrasonic vibration source, for applying a longitudinal standing wave. When the longitudinal standing wave is applied, the block 2 is excited into resonance, with the result that an output end face 5, arranged opposite the input end face 4, ultrasonically vibrates longitudinally with a uniform amplitude.

As for the block 2, the longitudinal dimension is set at a required value, the height dimension is set to be substantially equal to a half of an oscillation wavelength, and the thickness dimension is set to be equal to or less than a half, more preferably, equal to or less than a quarter, of the oscillation wavelength. The ultrasonic oscillator 3 is composed of a piezoelectric element 3*a*, block components 3*b* fastened against both ends of the piezoelectric element 3*a* with bolts, and a horn 3*c* fixed to one end of the block component 3*b*.

In the block 2, the input and output end faces 4 and 5 each have a portion which is longitudinally continuous therewith to form mass portions 6 and 7. Between these mass portions 6 and 7 are formed slits 9 at a pitch which is less than a half, more preferably, equal to or less than a quarter, of the oscillation wavelength, whereby a plurality of elastic portions 8 are formed. When the block 2 is excited into resonance, the mass portion 6, 7 and the elastic portion 8 absorb and release kinetic energy and elastic energy, respectively.

In the mass portion 6 on the side of the input end face 4 is formed a protrusion 10 having a height equal to or less than a quarter of the oscillation wavelength so as to correspond to each of the elastic portions 8. This allows the mass portion 6 to have a mass distribution. In the illustrative example, the ultrasonic oscillator 3 is connected to the center of the input end face 4 of the block 2, and the input end face 4 is stepped to provide protrusions 11*a* and 11*b*. The protrusion height increases with distance from the central portion. That is, in the input end face 4, no protrusion is formed in a part adjoining the central portion; formed in a part located outwardly adjacent to the central part is a protrusion 11*a* of height h1 (from the level of the central part); and formed in a part further located adjacent thereto is a protrusion 11*b* of height h2. The relationship between the heights h1 and h2 is given as: $h1<h2$.

Figure 1B:
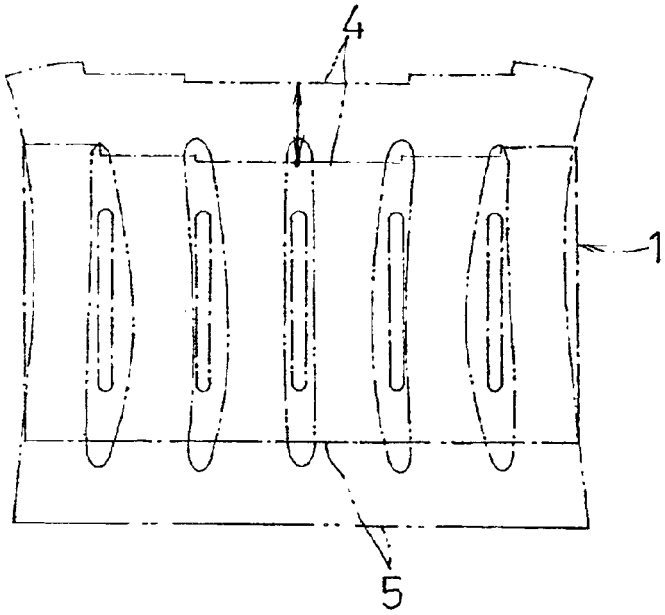

According to the construction described above, by providing a mass distribution for the mass portion 6 arranged close to the input end face 4, a uniform amplitude distribution across the entire width of the output end face 5 is achieved when the block 2 is excited into resonance. That is, as shown in FIG. 1B, in the ultrasonic vibration tool 1 whose configuration is represented by a dash-and-dot line, the vibrational mode observed when vibration is excited at the center of the input end face 4 is represented by a dash-dot-dot line. As a result, the amplitude of the output end face 5 is made uniform across the entire length thereof, thereby achieving a uniform amplitude distribution with high accuracy. Note that FIG. 1B is a view illustrating enlarged vibrational distortion.

Hence, the ultrasonic vibration tool achieves a uniform amplitude distribution despite having a simple structure. Moreover, since the protrusion 10 has a height equal to or less than a quarter of the oscillation wavelength, parasitic oscillation of bending mode never occurs.

Further, the height of the protrusion 10 increases with distance from the central portion of the input end face 4. Thus, by employing the single ultrasonic oscillator 3 connected to the central portion, a uniform amplitude distribution is achieved across the entire length of the block 2.

The protrusion 10 (11*a* and 11*b*) is so configured as to correspond to each of the elastic portions 8, and thereby a uniform amplitude distribution is achieved in a simple structure. Further, since the protrusion 10 is formed integrally with the block 2, the number of constituent components is reduced, and the structural strength is not adversely affected.

Figure 2A:
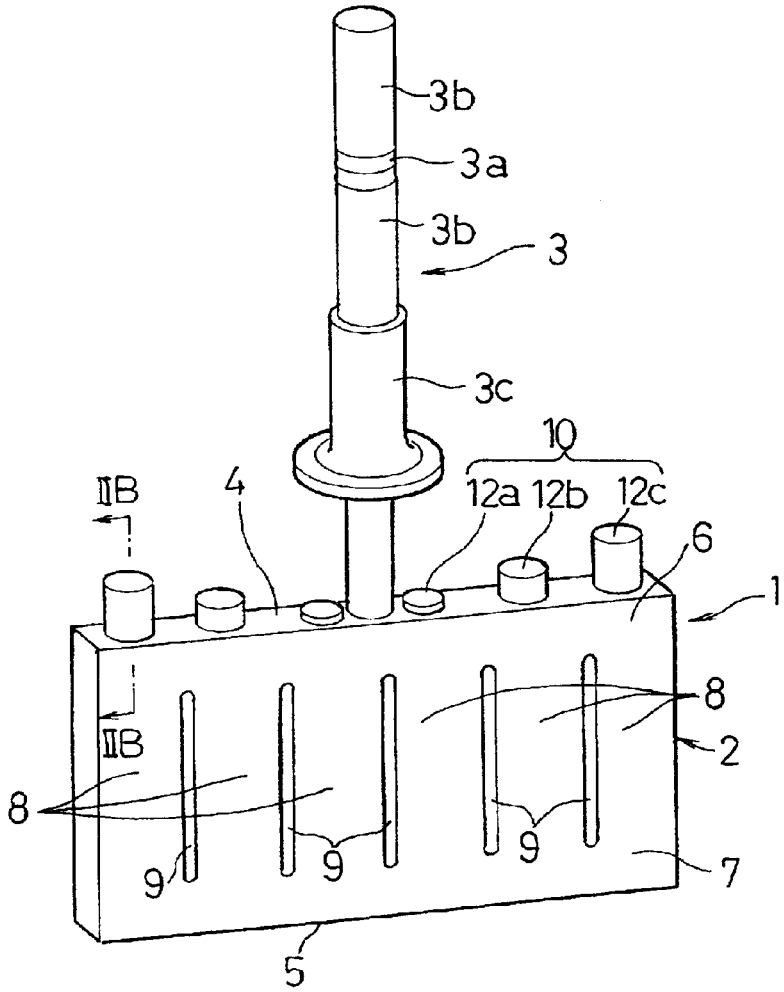
FIGS. 2A and 2B are diagrams of a modified example of the ultrasonic vibration tool of the first embodiment, where
Figure 2B:
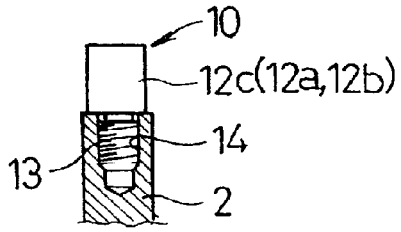

In the example shown in FIGS. 1A and 1B, the protrusion 10 is composed of the protrusions 11*a* and 11*b* of stepped configuration that are formed integrally with the block 2. However, as shown in FIG. 2A, the protrusion 10 may also be constructed by fixing to the input end face 4 protrusion forming members 12*a*, 12*b*, and 12*c*, which are provided separately from the block 2, in such a way as to correspond to the elastic portions 8. As seen from FIG. 2A, the protrusion forming members 12*a*, 12*b*, and 12*c* are made of small cylindrical members of different heights, and are arranged in order of height. As shown in FIG. 2B, any of the protrusion forming members 12*a*, 12*b*, and 12*c* is, at a fitting screw 13 formed on its bottom surface, screw-engaged in a screw hole 14 formed in the input end face 4 of the block 2.

The use of the separately provided projection forming members 12*a*, 12*b*, and 12*c*, despite leading to an increase in the number of constituent components and requiring care to see that adequate mounting strength is maintained, allows fine adjustments in accordance with the condition of the block 2.

Although explanation has been given to the case where the height of the protrusion 10 is changed gradually in conformity with the elastic portions 8 to vary the mass distribution of the mass portion 6, the protrusion 10 may also be so configured that its height varies continuously in the longitudinal direction of the block 2.

(Second Embodiment)

Next, with reference to FIGS. 3A and 3B, a second embodiment of the ultrasonic vibration tool according to the present invention will be described. Note that, in the following description, the components that play the same or corresponding roles as in the preceding embodiment will be identified with the same reference symbols, and overlapping descriptions will be omitted.

Figure 3A:
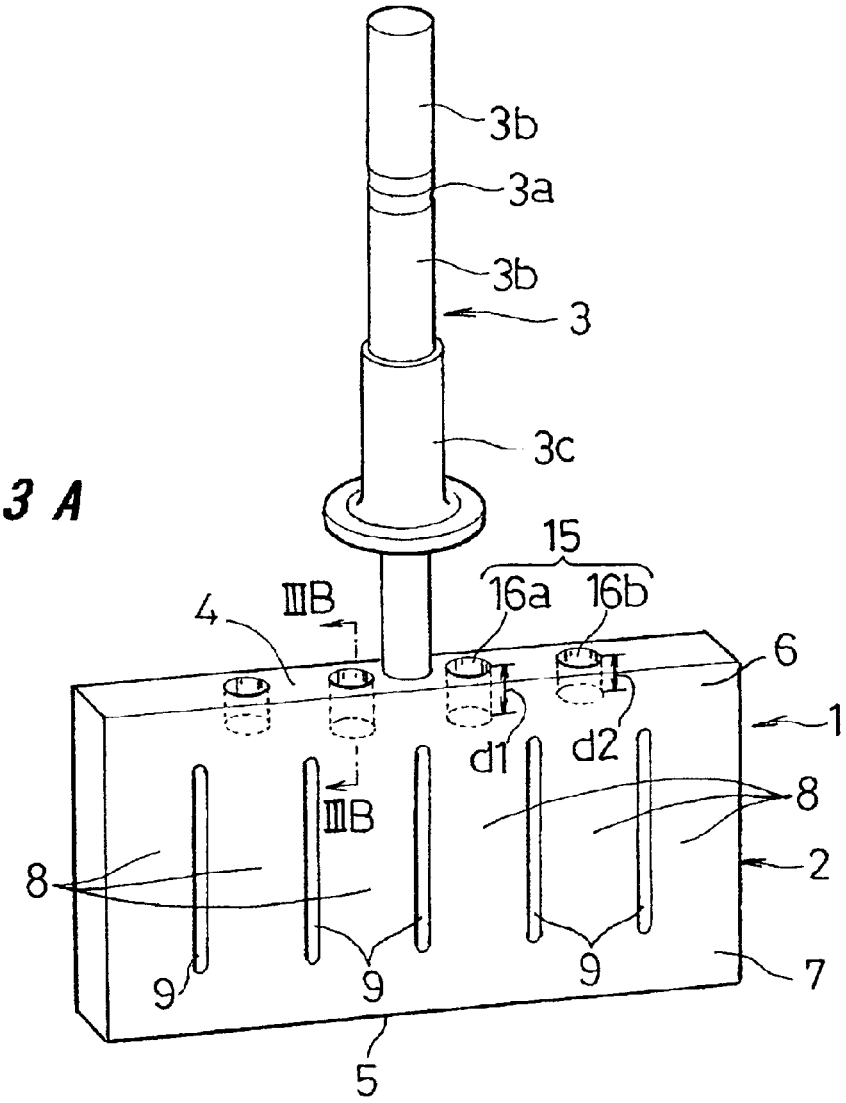
FIGS. 3A and 3B are diagrams of a ultrasonic vibration tool according to a second embodiment of the present invention, where
Figure 3B:
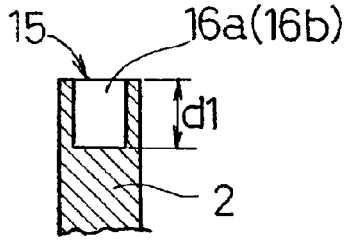

In this embodiment, as shown in FIG. 3A, in the mass portion 6 on the side of the input end face 4 is formed a recess 15 so as to correspond to each elastic portion 8, thereby providing a mass distribution. In the illustrative example, the ultrasonic oscillator 3 is connected to the center of the input end face 4. In the input end face 4, formed in a part adjoining the center is a circular hole 16*a* of depth d1, and formed in a part located outwardly adjacent to the part is a circular hole 16*b* of depth d2. No circular hole is formed in a part further located outwardly adjacent thereto. The relationship between the depths d1 and d2 is given as: d1>d2.

According to the second embodiment, a mass distribution is obtained by forming the recess 15 in the block 2. This helps prevent occurrence of parasitic oscillation of bending mode. Moreover, by composing the recess 15 of the circular holes 16*a* and 16*b*, the working operation is facilitated, additional components are eliminated, and adverse effects on the structural strength are prevented. Further, the depth of the recess 15 decreases with distance from the central portion of the input end face 4. Thus, by employing the single ultrasonic oscillator 3 connected to the central-portion, a uniform amplitude distribution is achieved across the entire length of the block 2.

Further, the recess 15 is so configured as to correspond to the elastic portions 8. This makes it possible to achieve a uniform amplitude distribution in a simple structure. Note that the recess 15 may also be so configured that its depth varies continuously in the longitudinal direction of the block 2 to achieve the same effect.

(Third Embodiment)

Next, with reference to FIGS. 4 and 5, a third embodiment of the ultrasonic vibration tool according to the present invention will be described.

In this embodiment, the elastic portions 8 have mutually different elastic coefficients so as for the output end face 5 to have a uniform amplitude distribution.

Figure 4:
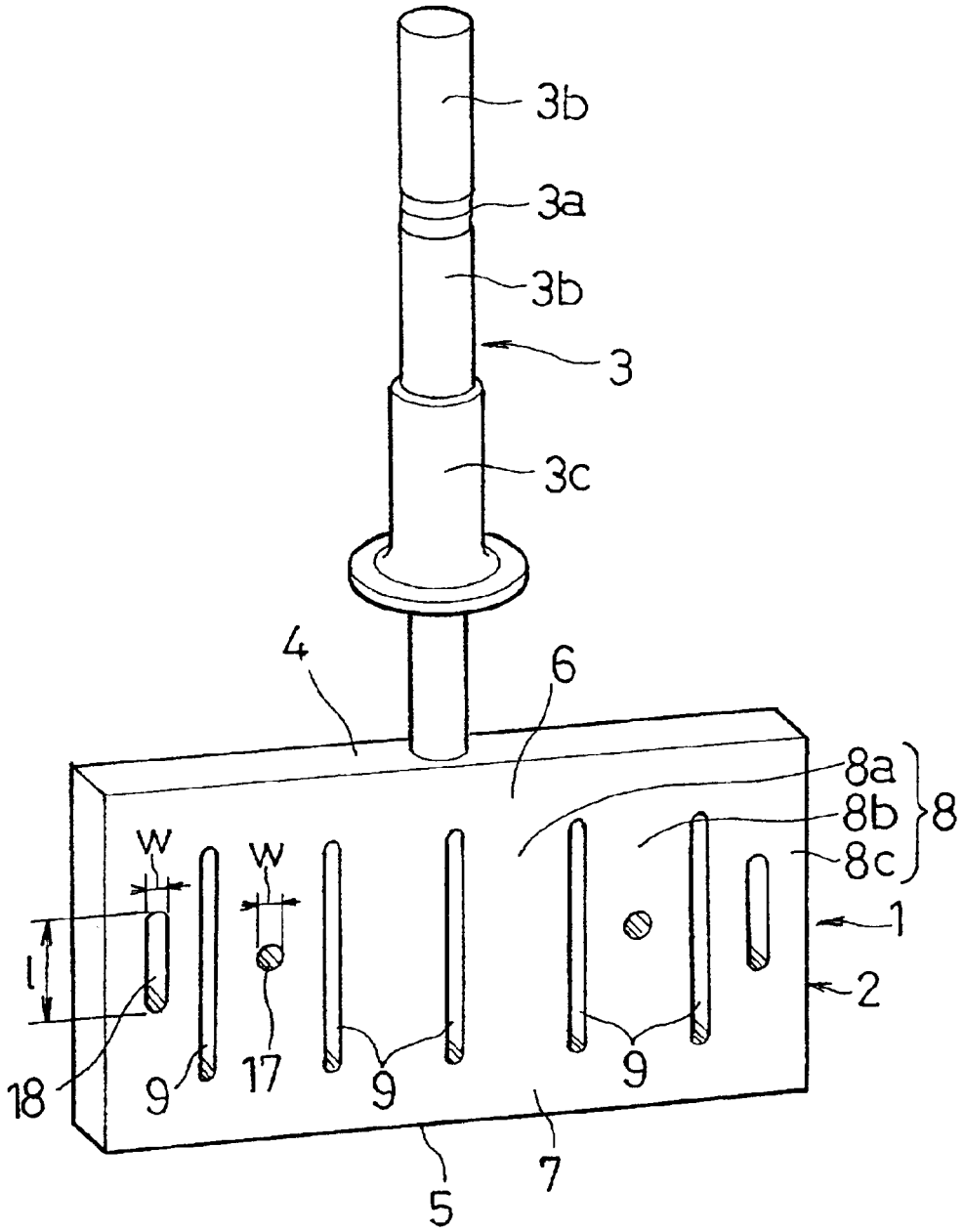
FIG. 4 is a perspective view of an ultrasonic vibration tool according to a third embodiment of the present invention.

In FIG. 4, the ultrasonic oscillator 3 is connected to the center of the input end face 4 of the block 2. An elastic portion 8 (8*a*) located on either side of the center is kept intact, an elastic portion 8 (8*b*) located outwardly adjacent to the elastic portion 8*a* has a circular hole 17 of a diameter w, and an elastic portion 8 (8*c*) located outwardly adjacent to the elastic portion 8*b* has a slit 18 which is elongated in the direction of the length of the elastic portion 8*c*. The slit 18 has a width of w and a length of l. As a result, each of the elastic portions 8*a*, 8*b*, and 8*c* is made to have a decreasing elastic coefficient in order.

As described above, the mass distribution of the mass portion 6 is made uniform, and the elastic portions 8 (8*a*, 8*b*, and 8*c*) have mutually different elastic coefficients. Also in this case, a uniform amplitude distribution across the length of the output end face 5 is achieved when the block 2 is excited into resonance. Moreover, since the elastic portion 8 is so configured that the elastic coefficient decreases with distance from the central portion of the input end face 4, by employing the single ultrasonic oscillator 3 connected to the central portion, a uniform amplitude distribution is achieved across the entire length of the block 2. Further, the sectional area and elastic coefficient of the elastic portion 8 can be varied by adjusting the sizes and lengths of the circular holes 17 and the slits 18. This facilitates the design and adjustment of the elastic coefficients.

Figure 5:
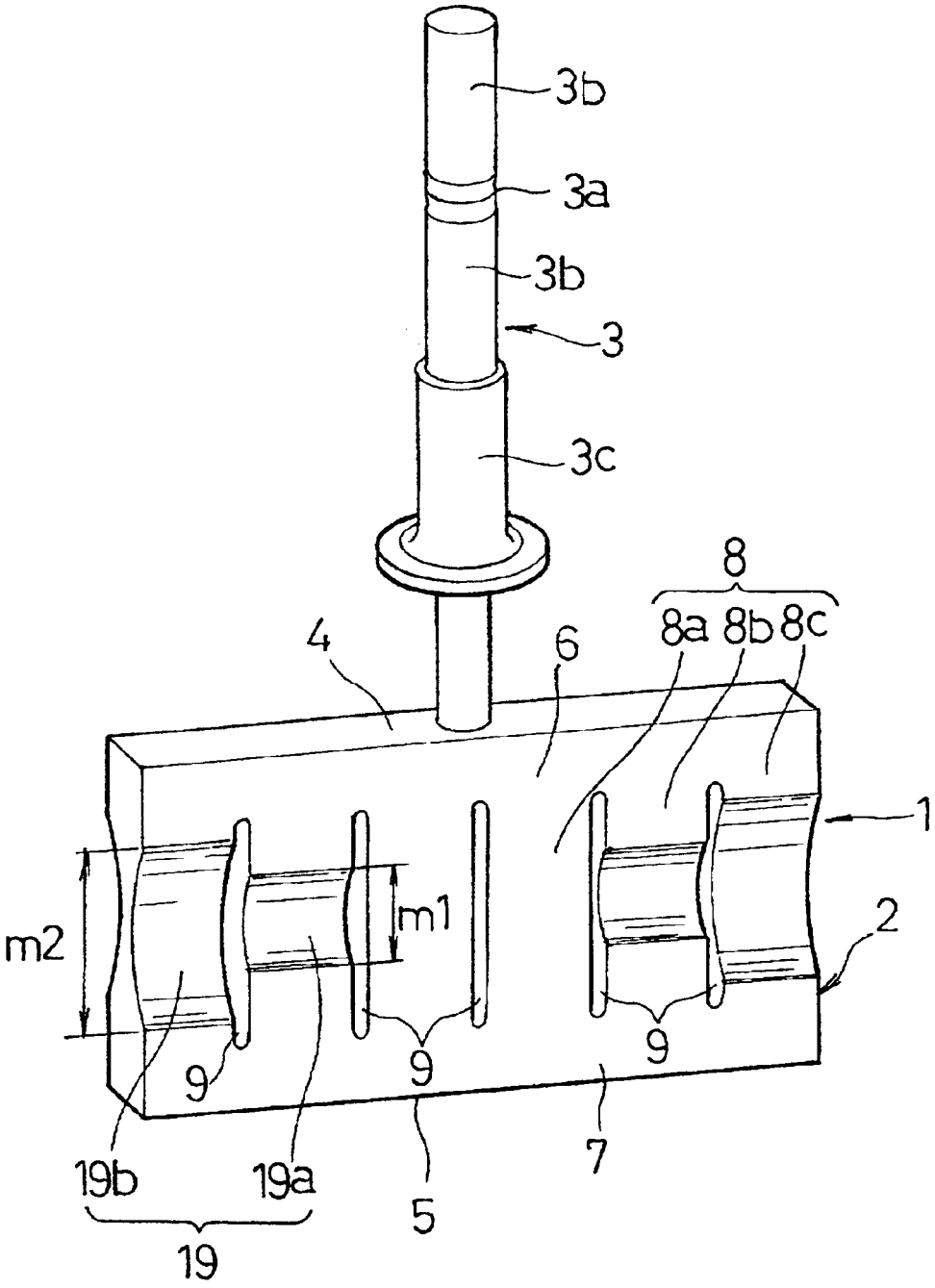
FIG. 5 is a perspective view of a modified example of the ultrasonic vibration tool of the third embodiment.

Alternatively, as shown in FIG. 5, the variation in elastic coefficient may be obtained by forming a recess 19 in the elastic portion 8. In FIG. 5, an elastic portion 8 (8*a*) located on either side of the center of the input end face 4 is kept intact, an elastic portion 8 (8*b*) located outwardly adjacent to the elastic portion 8*a* has a recess 19*a* of length m1, and an elastic portion 8 (8*c*) located outwardly adjacent to the elastic portion 8*b* has a recess 19*b* of length m2. Note that the recess 19*a*, 19*b* is formed on-both of the front and rear sides of the block 2. The relationship between the lengths m1 and m2 is given as: m1<m2. As a result, the elastic coefficient of the elastic portion 8 (8*a*, 8*b*, and 8*c*) decreases with distance from the central portion.

(Fourth Embodiment)

Next, with reference to FIG. 6, a fourth embodiment of the present invention will be described. The fourth embodiment deals with a fixing device for use in an image forming apparatus to which the ultrasonic vibration tool of the present invention is applied.

Figure 6:
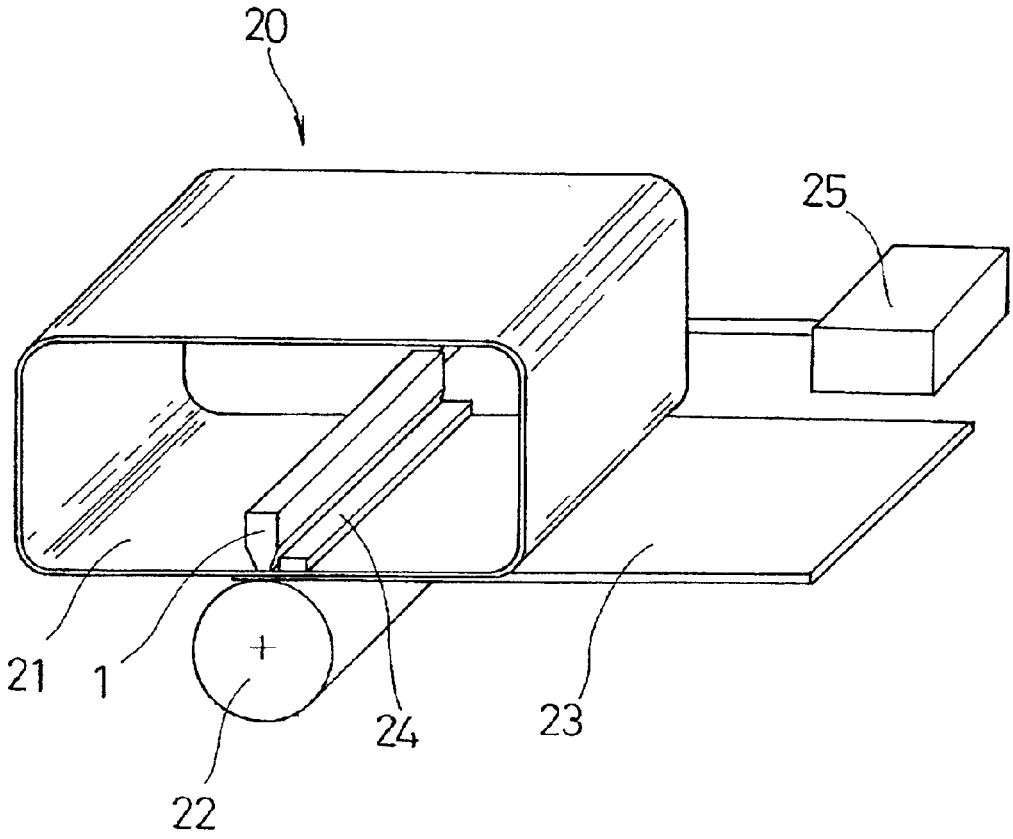
FIG. 6 is a perspective view schematically illustrating a fixing device according to a fourth embodiment of the present invention.

In FIG. 6, a fixing device 20 according to the fourth embodiment includes: the ultrasonic vibration tool 1 of the preceding embodiments; an ultrasonic oscillator (not shown); an endless intermediate belt 21 which is movable along the output end face of the ultrasonic vibration tool 1; and a pressure-applying roller 22 provided as a supporting member, which is arranged opposite the output end face of the ultrasonic vibration tool 1 via the endless intermediate belt 21. In the fixing device 20, a fixation sheet 23 is supplied between the pressure-applying roller 22 and the intermediate belt 21, and, in the state where the fixation sheet 23 is sandwiched between the pressure-applying roller 22 and the intermediate belt 21, ultrasonic vibrational energy is applied by the ultrasonic vibration tool 1 to toner deposited on the fixation sheet 23, thereby causing the toner to melt to fix the resultant toner image. Numeral 24 represents a toner scattering preventive member. When the intermediate belt 21 oscillates, the toner deposited on the fixation sheet 23 may be scattered. To prevent this, the toner scattering preventive member 24 inhibits the intermediate belt 21 from oscillation in front of the ultrasonic vibration tool 1. Numeral 25 represents an ultrasonic signal circuit for driving the ultrasonic oscillator.

In the fixing device 20 thus constructed, since the amplitude distribution of the ultrasonic vibration tool 1 is made uniform with high accuracy, vibrational energy is applied evenly across the entire width of the fixation sheet 23 via the intermediate belt 21. This allows the toner to be fixed properly, whereby high-quality images are formed with stability.

Note that substantially the same effect is obtained by forming a toner image on the intermediate belt 21 and then fixing the toner image to the fixation sheet 23.

Moreover, in a case where the toner is deposited on the fixation sheet 23 with a certain adhesion strength, the intermediate belt 21 does not necessarily have to be provided.

(Fifth Embodiment)

Next, with reference to FIG. 7, a fifth embodiment of the present invention will be described. The fifth embodiment deals with a fixing device for use in an image forming apparatus to which the ultrasonic vibration tool of the present invention is applied.

Figure 7:
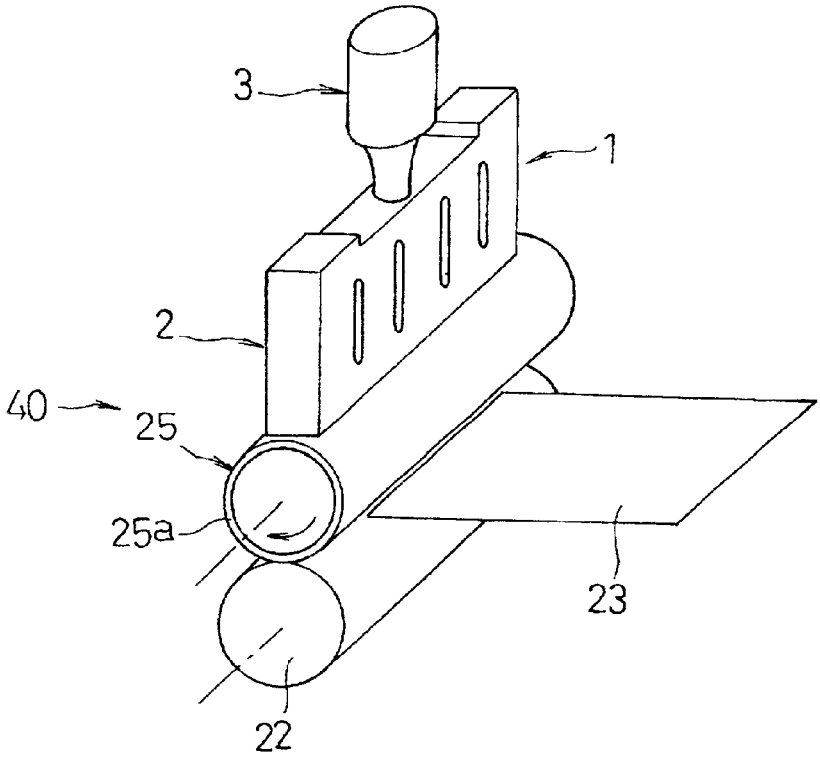
FIG. 7 is a perspective view schematically illustrating a fixing device according to a fifth embodiment of the present invention.

In FIG. 7, a fixing device 40 according to the fifth embodiment includes: a fixing roller 25 which is formed as a heat-transfer rotary body having a heat generating and transferring layer formed in the outer peripheral portion thereof; and a pressure-applying roller 22 acting as a supporting member. The fixing roller 25 is arranged opposite the output end face of the ultrasonic vibration tool 1. The pressure-applying roller 22 is arranged opposite the fixing roller 25. In this construction, a fixation sheet 23 is supplied between the fixing roller 25 and the pressure-applying roller 22. The fixing roller 25 has, in its outer peripheral portion, a rubber layer 25*a* for constituting the heat generating and transferring layer.

Also in the fifth embodiment, since vibrational energy is applied evenly across the entire width of the fixation sheet 23 via the fixing roller 25, the toner is fixed properly, whereby high-quality images are formed with stability. In this embodiment, although it is necessary to secure a sufficiently large space for disposing the fixing roller 25, the fixation sheet 23 is not directly subjected to the oscillation of the ultrasonic vibration tool 1 but receives only the heat generated. This prevents occurrence of irregularity in the toner image.

(Sixth Embodiment)

Next, with reference to FIG. 8, a sixth embodiment of the present invention will be described. The sixth embodiment deals with a fixing device for use in an image forming apparatus to which the ultrasonic vibration tool of the present invention is applied.

Figure 8:
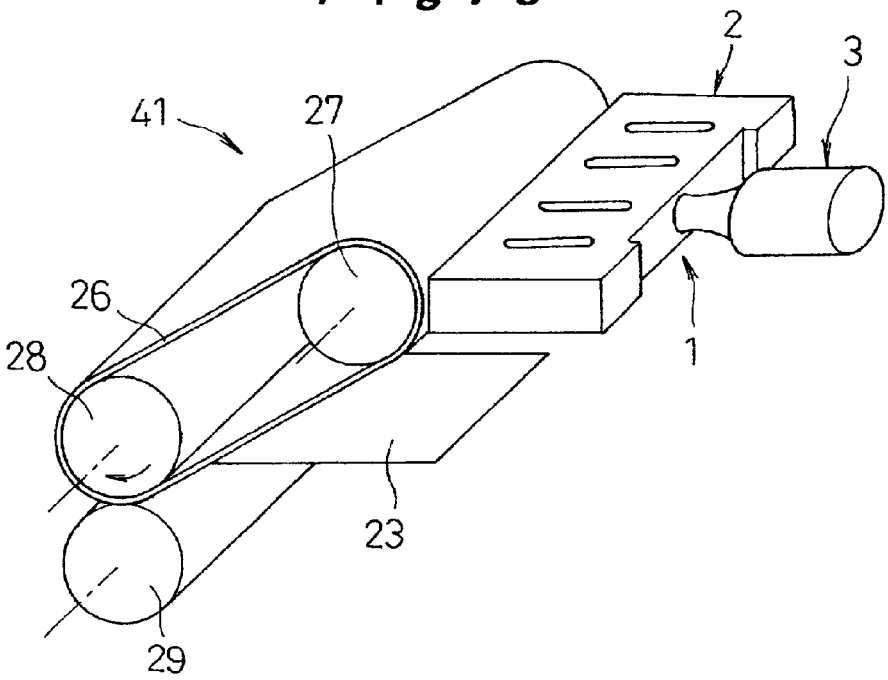
FIG. 8 is a perspective view schematically illustrating a fixing device according to a sixth embodiment of the present invention.
Figure 9A:
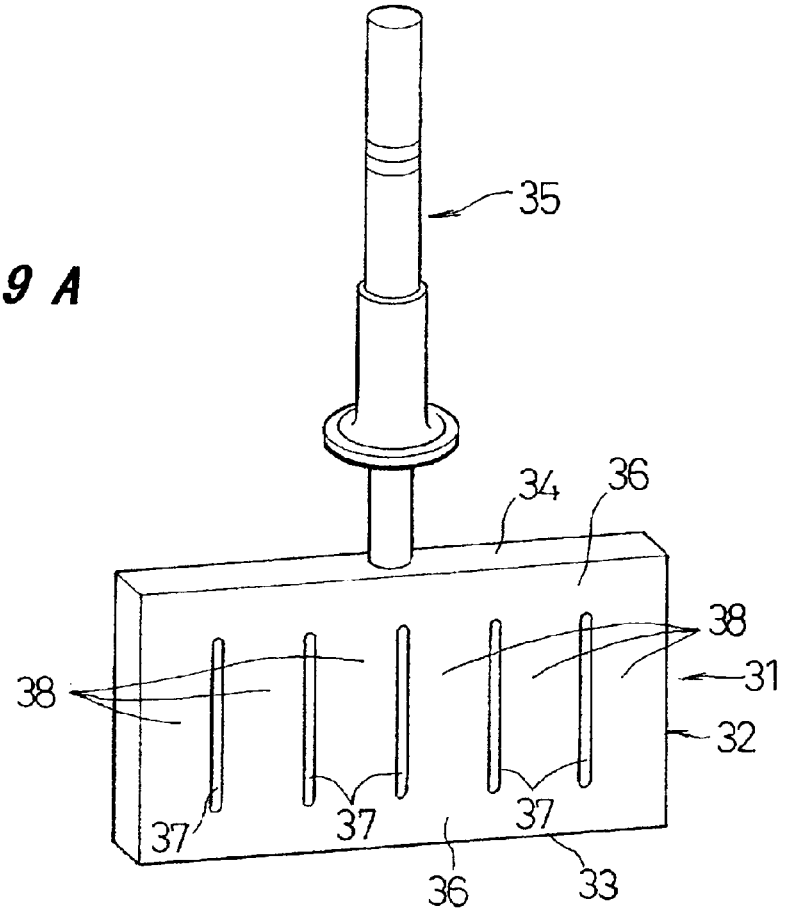
Prior Art Fig. 9A
FIGS. 9A and 9B are diagrams of a conventional ultrasonic vibration tool, where
Figure 9B:
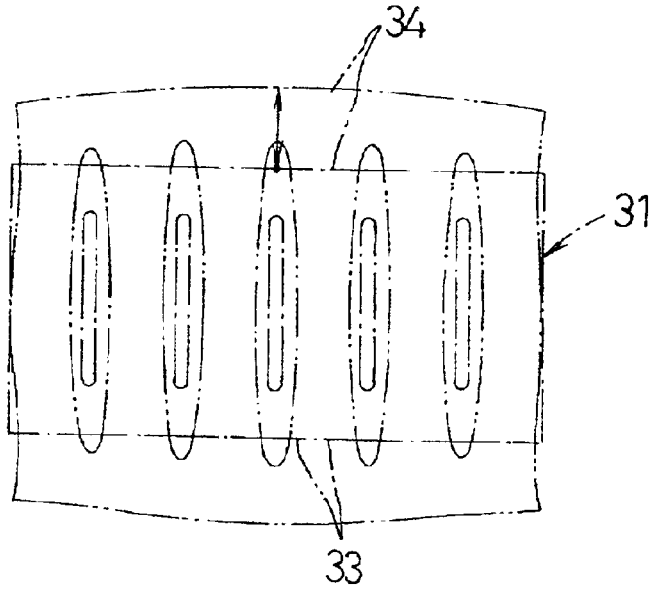
Figure 10:
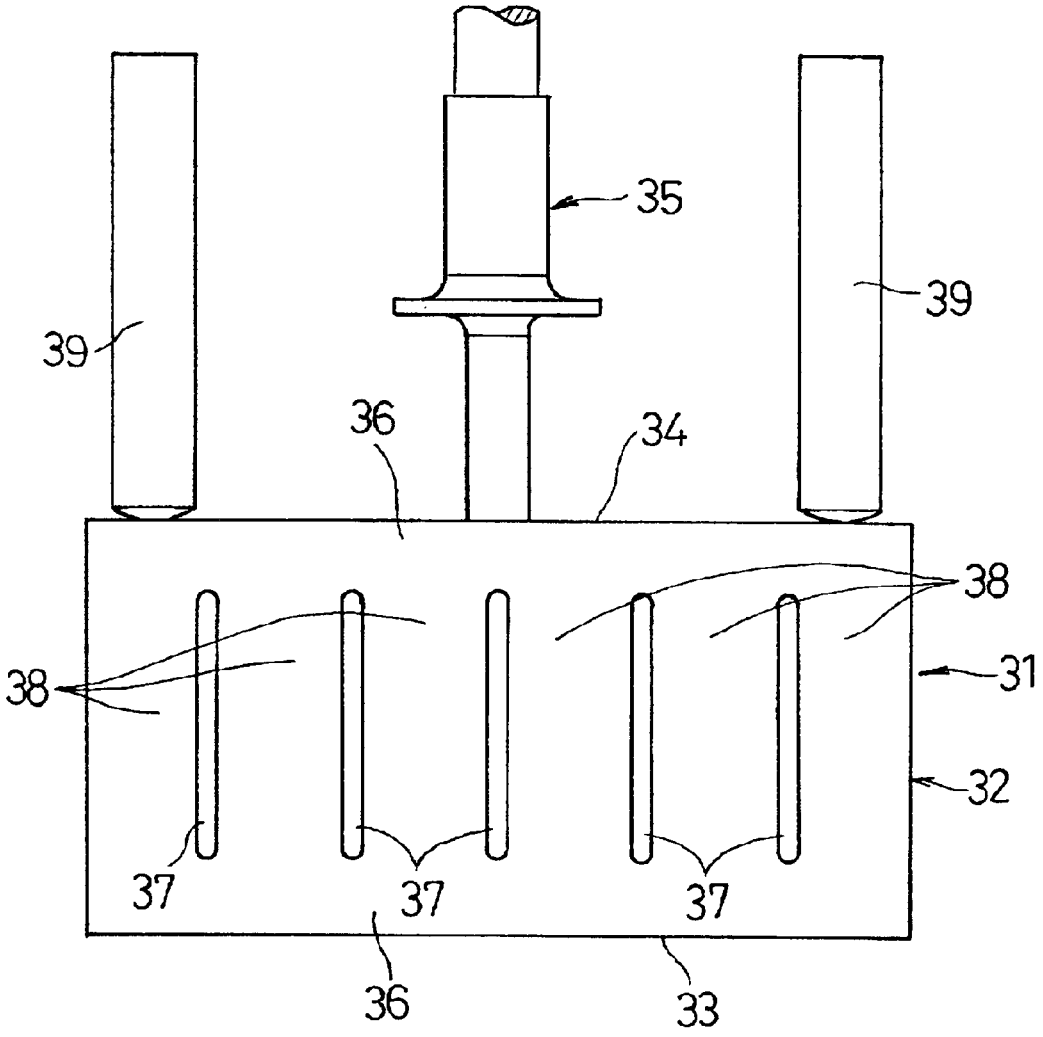
Fig. 10 Prior Art
FIG. 10 is a front view of another conventional ultrasonic vibration tool.

In FIG. 8, a fixing device 41 according to the sixth embodiment employs a fixing belt 26. The fixing belt 26 is so formed as to be entrained about a supporting roller 27 and a pressure-applying roller 28. The supporting roller 27 has a rubber layer formed in its outer peripheral portion and is arranged opposite the output end face of the ultrasonic vibration tool 1, and the pressure-applying roller 28 is arranged opposite a supporting roller 29 acting as a supporting member. In the sixth embodiment, substantially the same effect as achieved in the above-described embodiments is obtained.

Substantially the same effect is also achieved by applying the ultrasonic vibration tool 1 of the present invention to a heating device for use in, for example, an apparatus for welding a synthetic resin sheet. That is, a heating device to which the present invention is applied is provided with the above-described ultrasonic vibration tool 1, an ultrasonic oscillator 3 acting as an ultrasonic vibration source, and a supporting member disposed opposite the output end face of the ultrasonic vibration tool 1. A sheet being heated is supplied and discharged between the output end face of the ultrasonic vibration tool 1 and the supporting member. Also in this construction, the amplitude distribution of the ultrasonic vibration tool is made uniform with high accuracy. This makes it possible to apply vibrational energy evenly across the entire width of the sheet being heated, thereby heating the sheet uniformly.

According to the present invention, an ultrasonic vibration tool is made of a block of substantially rectangular parallelepiped form, and has its one end face formed as an output end face, and has its other end face opposite the output end face formed as an input end face. An ultrasonic vibration source is connected to the input end face for transmitting a longitudinal standing wave to the output end face. In this construction, a mass distribution is provided in the vicinity of the input end face, so that a uniform amplitude distribution is achieved in the output end face. This frees the ultrasonic vibration tool from adverse effects such as parasitic oscillation of bending mode.

Moreover, instead of varying the mass distribution, it is also possible to allow the elastic portions to have mutually different elastic coefficients.

Further, according to the present invention, a fixing device is provided with the above-described ultrasonic vibration tool, an ultrasonic vibration source, and a supporting member disposed opposite the output end face of the ultrasonic vibration tool. A fixation sheet is supplied between the output end face of the ultrasonic vibration tool and the supporting member. In this construction, since the amplitude distribution of the ultrasonic vibration tool is made uniform with high accuracy, it is possible to apply vibrational energy evenly across the entire width of the sheet, thereby achieving high-quality images with stability.

Still further, according to the present invention, a heating device is provided with the above-described ultrasonic vibration tool, an ultrasonic vibration source, and a supporting member disposed opposite the output end face of the ultrasonic vibration tool. A sheet being heated is supplied and discharged between the output end face of the ultrasonic vibration tool and the supporting member. In this construction, since the amplitude distribution of the ultrasonic vibration tool is made uniform with high accuracy, it is possible to apply vibrational energy evenly across the entire width of the sheet being heated.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. An ultrasonic vibration tool comprising:

a block of substantially rectangular parallelepiped form, the block including a longitudinal side face, an end face formed as an output end face, and another end face opposite the output end face formed as an input end face, said input face having a central portion;

an ultrasonic vibration source connected to said central portion of the input end face;

mass portions, said mass portions being formed on said longitudinal side face of said block, said mass portions being located at peripheries of said output and input end faces of said block;

at least three slits, said slits being formed between said mass portions for defining a plurality of elastic portions, said slits being spaced at a pitch which is equal to or less than a quarter of an oscillation wavelength;

protrusions, said protrusions protruding from said mass portions on said input face, said protrusion having a height equal to or less than a quarter of the oscillation wave length; and said height of said protrusions increasing with distance from said central portion, said protrusions forming a mass distribution in said mass portion that provides a uniform amplitude distribution in said output end face.

2. The ultrasonic vibration tool according to claim 1, wherein the protrusion is formed integrally with the block so as to correspond to each of the elastic portions.

3. The ultrasonic vibration tool according to claim 1, wherein the protrusion is formed by fixing a separate protrusion forming member to the block so as to correspond to each of the elastic portions.

4. A fixing device comprising:

the ultrasonic vibration tool as set forth in claim 1; and a supporting member disposed opposite the output end face of the ultrasonic vibration tool, wherein a fixation sheet is supplied between the output end face of the ultrasonic vibration tool and the supporting member.

5. The fixing device according to claim 4, further comprising an intermediate belt which is movable along the output end face of the ultrasonic vibration tool, wherein a fixation sheet is supplied between the supporting member and the intermediate belt.

6. A fixing device comprising:

the ultrasonic vibration tool as set forth in claim 1;

a heat-transfer rotary body disposed opposite the output end face of the ultrasonic vibration tool, the heat-transfer rotary body having a heat generating and transferring layer formed in an outer peripheral portion thereof; and a supporting member disposed opposite the heat-transfer rotary body, wherein a fixation sheet is supplied between the heat-transfer rotary body and the supporting member.

7. The fixing device according to claim 6, wherein the heat-transfer rotary body is composed of a fixing roller which has a rubber layer formed in an outer peripheral portion thereof.

8. A heating device comprising:

the ultrasonic vibration tool as set forth in claim 1; and a supporting member disposed opposite the output end face of the ultrasonic vibration tool, wherein a sheet being heated is supplied and discharged between the output end face of the ultrasonic vibration tool and the supporting member.

9. An ultrasonic vibration tool comprising:

a block of substantially rectangular parallelepiped form, the block including an end face formed as an output end face, and another end face opposite the output end face formed as an input end face;

an ultrasonic vibration source connected to the input end face, wherein a mass distribution is provided in a vicinity of the input end face to ensure a uniform amplitude distribution in the output end face; wherein:

at a longitudinal side face of the block, peripheries of the output and input end faces each constitute a mass portion, and slits are formed between the mass portions at a pitch which is less than a half of an oscillation wavelength to obtain a plurality of elastic portions, and the mass portion on a side of the input end face includes a recess.

10. The ultrasonic vibration tool according to claim 9, wherein the recess is so formed as to correspond to each of the elastic portions.

11. An ultrasonic vibration tool comprising:

a block of substantially rectangular parallelepiped form, the block including an end face formed as an output end face, and another end face opposite the output end face formed as an input end face;

an ultrasonic vibration source connected to the input end face, wherein a mass distribution is provided in a vicinity of the input end face to ensure a uniform amplitude distribution in the output end face;

wherein the ultrasonic vibration source is connected to a central portion of the input end face, and a recess whose depth decreases with distance from the central portion is formed in the input end face.

12. An ultrasonic vibration tool comprising:

a block of substantially rectangular parallelepiped form, the block including an end face formed as an output end face, and another end face opposite the output end face formed as an input end face; and an ultrasonic vibration source connected to the input end face, wherein peripheries of the output and input end faces each constitute a mass portion, and slits are formed between the mass portions at a pitch which is equal to or less than a quarter of an oscillation wavelength to obtain a plurality of elastic portions, and the elastic portions have mutually different elastic coefficients so as to ensure a uniform amplitude distribution in the output end face.

13. The ultrasonic vibration tool according to claim 12, wherein the elastic coefficients of the elastic portions are varied by varying cross-sectional areas thereof.

14. The ultrasonic vibration tool according to claim 12, wherein the ultrasonic vibration source is connected to a central portion of the input end face, and the elastic coefficients of the elastic portions decrease with distance from the central portion.

15. A fixing device comprising:

the ultrasonic vibration tool as set forth in claim 12; and a supporting member disposed opposite the output end face of the ultrasonic vibration tool, wherein a fixation sheet is supplied between the output end face of the ultrasonic vibration tool and the supporting member.

16. The fixing device according to claim 15, further comprising an intermediate belt which is movable along the output end face of the ultrasonic vibration tool, wherein a fixation sheet is supplied between the supporting member and the intermediate belt.

17. A fixing device comprising:

the ultrasonic vibration tool as set forth in claim 12;

a heat-transfer rotary body disposed opposite the output end face of the ultrasonic vibration tool, the heat-transfer rotary body having a heat generating and transferring layer formed in an Outer peripheral portion thereof; and a supporting member disposed opposite the heat-transfer rotary body, wherein a fixation sheet is supplied between the heat-transfer rotary body and the supporting member.

18. The fixing device according to claim 17, wherein the heat-transfer rotary body is composed of a fixing roller which has a rubber layer formed in an outer peripheral portion thereof.

19. The fixing device according to claim 17, wherein the heat-transfer rotary body is composed of a fixing belt which has a rubber layer formed in an outer peripheral portion thereof, the fixing belt being entrained about a supporting roller and a pressure-applying roller, the supporting roller being arranged opposite the output end face of the ultrasonic vibration tool, the pressure-applying roller being arranged opposite the supporting member.

20. A heating device comprising:

the ultrasonic vibration tool as set forth in claim 12; and a supporting member disposed opposite the output end face of the ultrasonic vibration tool, wherein a sheet being heated is supplied and discharged between the output end face of the ultrasonic vibration tool and the supporting member.

* * * * *